US012390687B2

(12) United States Patent
Younane

(10) Patent No.: US 12,390,687 B2
(45) Date of Patent: Aug. 19, 2025

(54) ORO-FACIAL EXERCISER

(71) Applicant: Paul Younane, Petersfield (GB)

(72) Inventor: Paul Younane, Petersfield (GB)

( * ) Notice: Subject to any disclaimer, the term of this patent is extended or adjusted under 35 U.S.C. 154(b) by 160 days.

(21) Appl. No.: 18/113,045

(22) Filed: Feb. 22, 2023

(65) Prior Publication Data

US 2023/0293938 A1 Sep. 21, 2023

(51) Int. Cl.

| | |
|---|---|
| ***A63B 23/03*** | (2006.01) |
| ***A63B 21/00*** | (2006.01) |
| ***A63B 21/02*** | (2006.01) |
| ***A63B 21/04*** | (2006.01) |
| ***A63B 21/05*** | (2006.01) |

(52) U.S. Cl.

CPC ..... *A63B 23/032* (2013.01); *A63B 21/023* (2013.01); *A63B 21/0421* (2013.01); *A63B 21/05* (2013.01); *A63B 21/4047* (2015.10); *A63B 21/00061* (2013.01)

(58) Field of Classification Search

CPC . A63B 23/032; A63B 21/023; A63B 21/0421; A63B 21/05; A63B 21/4047; A63B 21/00058; A63B 21/00061; A63B 21/04; A63B 21/4003; A63B 23/03; A63B 23/025

See application file for complete search history.

(56) References Cited

U.S. PATENT DOCUMENTS

| | | | | |
|---|---|---|---|---|
| 3,525,520 A | | 8/1970 | Patricia | |
| 4,671,260 A | | 6/1987 | Buckner | |
| 5,690,596 A | * | 11/1997 | Parker | A63B 21/0004 482/121 |
| 7,134,986 B2 | * | 11/2006 | Tiberio | A63B 23/032 482/93 |
| 9,149,675 B2 | * | 10/2015 | Kubik | A63B 21/4047 |
| 9,180,336 B2 | * | 11/2015 | Mohammed | A63B 21/0004 |
| 11,857,835 B2 | * | 1/2024 | Demelo | A63B 21/4035 |
| 2004/0166993 A1 | * | 8/2004 | Tiberio | A63B 23/032 482/124 |
| 2014/0113771 A1 | * | 4/2014 | Kubik | A63B 21/028 482/11 |

FOREIGN PATENT DOCUMENTS

| | | | | |
|---|---|---|---|---|
| CN | 108525215 A | * | 9/2018 | A63B 21/05 |
| WO | WO-9851377 A1 | * | 11/1998 | A63B 21/0004 |

* cited by examiner

*Primary Examiner* — Megan Anderson

(74) *Attorney, Agent, or Firm* — Invention To Patent Services; Alex Hobson

(57) ABSTRACT

An oro-facial exerciser apparatus for exercising and training the muscles of the lips and cheeks of a user's face, utilizes a pair of legs that are pivotally connected together to pivot between a substantially closed together state and a splayed apart state. The legs each have a proximal end proximate the pivot and a distal end remote from the pivot having a mouth mounting formation to mount the distal end to a respective opposing location of the user's mouth and the exerciser further has a resilient biasing means between the legs to bias them towards a splayed state and thereby provide a resistance force against which the user's lips and/or cheeks press in use for exercising and training the muscles. The resilient biasing means are demountably mounted on the legs, enabling them to be replaced with an alternative biasing means for altering the resistance.

14 Claims, 2 Drawing Sheets

ORO-FACIAL EXERCISER

CROSS REFERENCE TO RELATED APPLICATIONS

The present application claims the benefit of Great Britain application No. GB20220003550, filed on Mar. 15, 2022; the entirety of which is hereby incorporated by reference.

BACKGROUND OF THE INVENTION

Field of the Invention

The present invention concerns improvements in and relating to oro-facial exercise equipment. In particular, the invention concerns oro-facial exerciser apparatus for exercising and training the muscles of the mouth and especially the lips and the cheeks of a user's face.

Background

Facial Exercisers to strengthen, tone and condition the facial muscles can be an important tool in both medical physiotherapy (orofacial myo-functional therapy) and for beauty/cosmetic treatment. Oro-facial exercisers for exercising the muscles surrounding the mouth including the orbicularis oris muscle complex of the lips can serve therapeutically to improve mouth closure and address problems of drooling, mastication dysfunction, speech problems and other oral-related disabilities and conditions. Oro-facial exercisers that exercise the cheek muscles can inter-alia counteract facial loosening, whether from disease or age-related weakening of muscles, thereby reducing or eliminating sagging jowls or plumping or toning the cheeks for example. In exercising the lips, exercisers can furthermore improve quality of lip pout or tone as beauty/cosmetic treatment without the potentially seriously harmful recourse to collagen fillers or Botox® treatment that are currently very popular beauty treatments. Such exerciser devices are variously known commercially as lip trainers and oral trainers. They are for lip and cheek training not for jaw muscle/bite training.

The most basic lip trainers and oral trainers for resistance training of the lip and cheek muscles (as opposed to electro-stimulatory devices) take the form of elastomeric mouth bungs or arcuate mouth guard-shaped bodies that are designed to be placed in the mouth between the lips to be repeatedly resiliently compressed in pressing together the lips. An example of this type of simple exerciser is disclosed in US patent U.S. Pat. No. 3,525,520. Such devices can be low-cost but they are of limited functionality and lack adaptability, they don't suit all patients and they provide no adjustment in resistance. More versatile are resiliently-biased linear-reciprocating oral trainers of which there are very many similar devices in the art such as disclosed in US patent U.S. Pat. No. 4,671,260 and others. However, most such devices are awkward to use and maintain and are liable to breakage.

SUMMARY OF THE INVENTION

According to a first aspect of the present invention there is provided an oro-facial exerciser apparatus according to claim 1, e.g. for exercising and training the muscles of the lips and cheeks of a user's face, the exerciser comprising a pair of legs that are pivotally connected together to pivot between a first, e.g. substantially closed together, state and a second, e.g. splayed apart, state. The legs each have a proximal end proximate the pivot and a distal end remote from the pivot, the distal end of each leg having a mouth mounting formation to mount the distal end to a respective opposing location of the user's mouth. The exerciser further has a resilient biasing means between the legs to bias them towards the second, splayed, state and thereby provide a resistance force against which the user's lips or cheeks press in use for exercising and training the muscles.

The resilient biasing means is particularly preferably de-mountably mounted to the legs to be replaceable. The resilient biasing means is preferably a compression coil spring.

Preferably the apparatus comprises a set of differing resilient biasing means each to provide a different resistance force or of different lengths to enable escalating resistance training or to better suit individual user's needs.

Preferably the apparatus has a pair of mounting lugs by which the resilient biasing means is de-mountably mounted onto the apparatus, with a respective lug (i.e. protrusion) on each leg, the lugs extending projecting towards each other between the legs and the resilient biasing means mounting on one lug at one end and the other lug at the other end and spanning between the legs.

The legs may splay and close together in a common plane and the mouth-mounting formations suitably extend projecting outwardly from the common plane of the legs so that with the legs held upright and substantially plane parallel to the user's mouth the mouth-mounting formations project towards the user's mouth.

The mouth-mounting formations are preferably lip-mounting formations. They suitably extend projecting in opposing directions to each other outwardly oblique/transverse to the legs and not between the legs. The formations are preferably not oriented parallel to each other but extend angled, splayed apart.

The lip-mounting formations suitably each have an outer concave surface to sit as a saddle or cradle over the user's lip at the respective corner of the user's mouth.

In an alternative embodiment the mouth-mounting formations are cheek abutting formations adapted to be inserted within the user's mouth with one at each respective corner of the mouth pressing against the user's cheek. The cheek mounting formations suitably each have an outer convex surface to press against the cheek at the respective corner of the user's mouth.

By configuring the oro-facial exerciser apparatus in the manner described, a number of distinct features and benefits arise. The geometry of the exerciser apparatus is particularly well ergonomically adapted to be used comfortably and effectively with the legs spanning between the corners of the user's mouth so that the user can exercise their cheeks and lips in compression and by virtue of ease of de-mountability of the spring the apparatus is very versatile in use for progressive training and for applicability across a wide range of user mouth sizes.

BRIEF DESCRIPTION OF THE DRAWINGS

A preferred embodiment of the present invention will now be more particularly described by way of example with reference to the accompanying drawings wherein.

DETAILED DESCRIPTION OF THE ILLUSTRATED EMBODIMENTS

Figure 1:
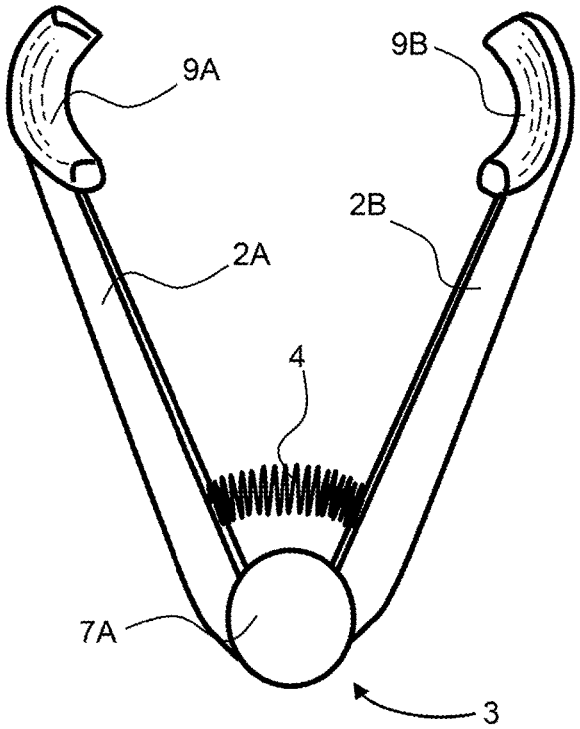
FIG. 1 is a frontal view of a first embodiment of the oro-facial exerciser apparatus.
Figure 2:
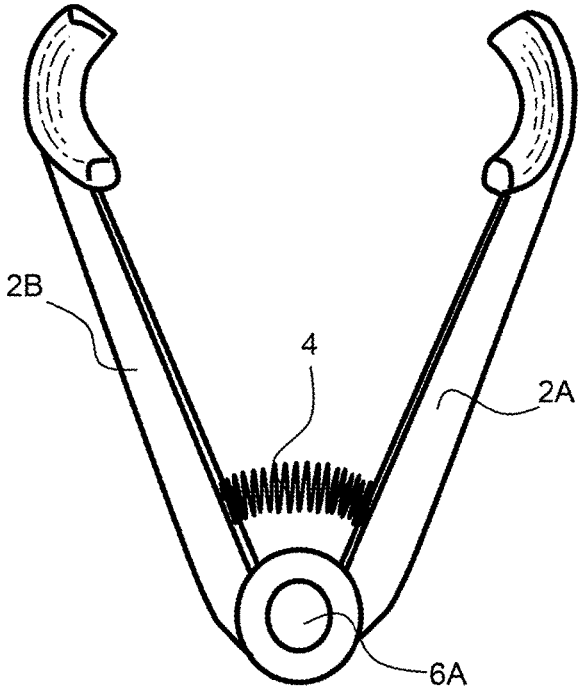
FIG. 2 is a rear view of the first embodiment of exerciser apparatus.
Figure 3:
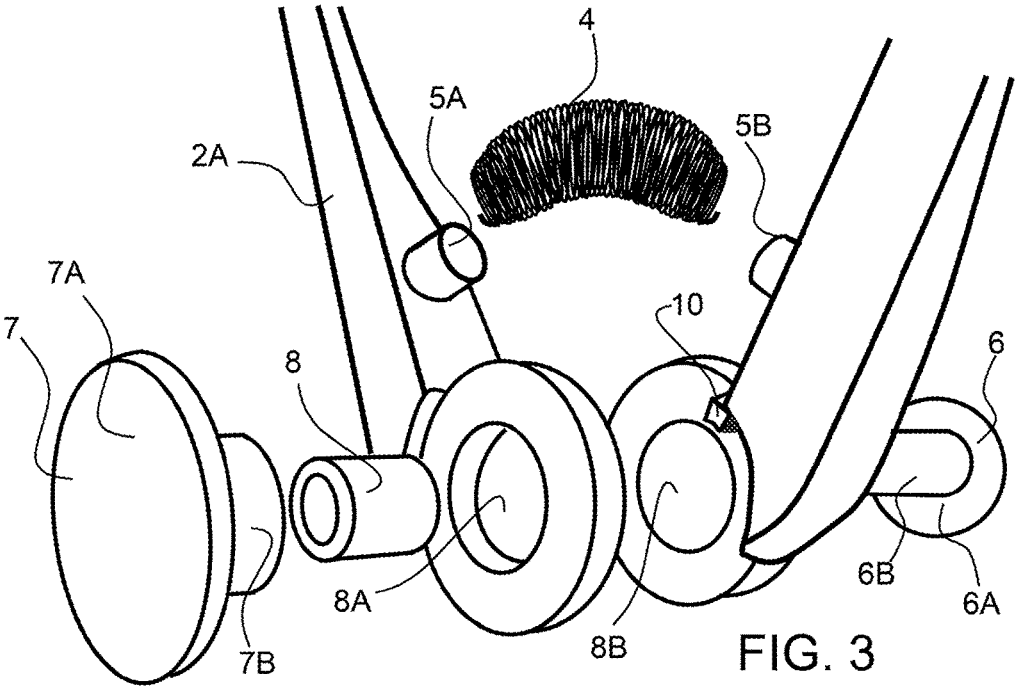
FIG. 3 is an exploded assembly view of the exerciser apparatus.
Figure 4:
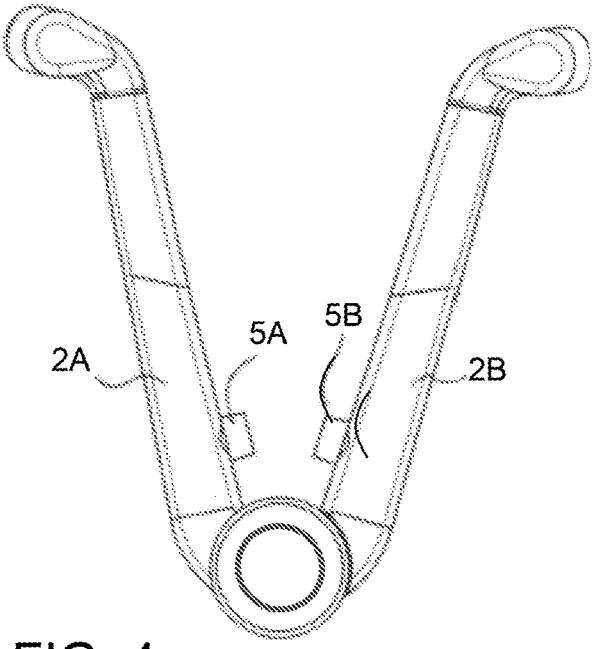
FIG. 4 is a frontal view of a preferred second embodiment of the oro-facial exerciser apparatus.
Figure 5:
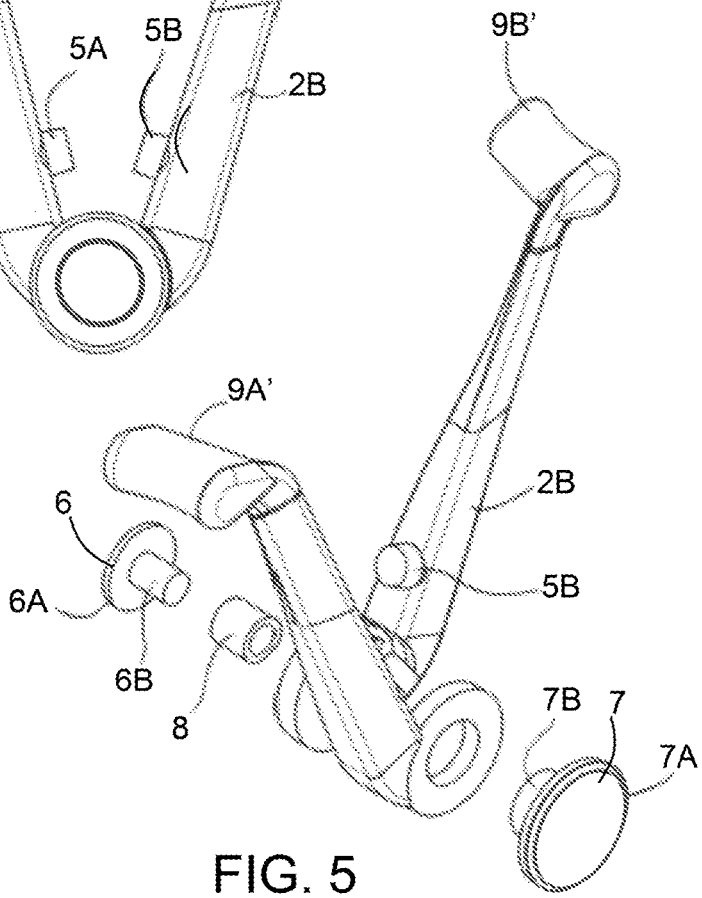
FIG. 5 is an exploded assembly view of the second embodiment of exerciser apparatus.
Figure 6:
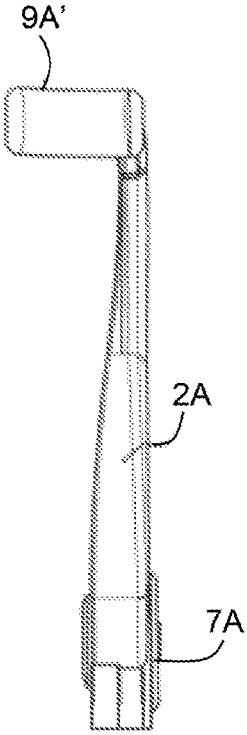
FIG. 6 is a right side elevation view of the second embodiment of exerciser apparatus.
Figure 7:
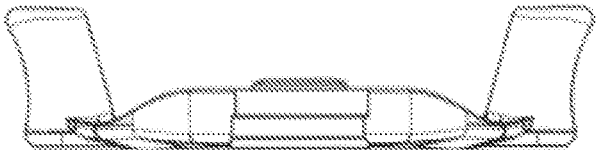
FIG. 7 is a plan view from below of the second embodiment of exercise apparatus.

Referring to FIG. 1, the illustrated first embodiment of oro-facial exerciser apparatus 1 resembles a pair of dividers or calipers. It comprises a pair of legs 2A, 2B that are hinged together at their proximal ends by a pivot assembly 3 and biased to a splayed state by a coil compression spring 4 that is de-mountably fitted spanning between the legs 2A, 2B. The respective ends of the spring 4 are mounted on opposing lugs 5A, 5B near the proximal ends of the legs 2A, 2B.

The pivot assembly 3 comprises: a bolt 6 having a head 6A and a shank 6B; a pivot cap 7 having a large discoid cap head 7A and a raised annular socket 7B that receives and holds the end of the shank 6B of the bolt 6 by friction fit or screw threads; and a bushing/sleeve 8 that ensheathes the mid-section of the shank 6B of the bolt 6. The outer cylindrical wall surface of the pivot cap's raised annular socket 7B is closely accommodated extending through a respective pivot socket hole 8A, 8B through the proximal end of each leg 2A. 2B, respectively.

The distal ends of the legs 2A, 2B are modified to define a pair of opposing mouth mounting formations 9A, 9B. The mouth mounting formations 9A, 9B of this first embodiment each comprise an arcuate protrusion from the distal end of the respective leg 2A, 2B that projects from the leg 2A, 2B and curves inwardly and forwardly from the front face/plane of the apparatus and which thereby presents a convex curved laterally outward facing arcuate surface that is configured to abut/press out against the inner wall of the user's cheek when the oro-facial exerciser apparatus 1 is inserted into the user's mouth.

The maximum extent of splay of the legs 2A, 2B is delimited by end stops 10, protrusions from the legs 2A, 2B at their mutually abutting faces around the pivot socket holes 8*a*, 8*b*. In the illustrated example the angle of splay of the legs 2A, 2B at rest/maximum splay is about 60 degrees and the convex curved laterally outward facing arcuate surfaces of the pair of the cheek mounting formations 9A, 9B are thereby spaced about 8 cm apart. This suits the majority of user mouth sizes, noting that a wide range of mouth sizes may be accommodated through changing the length of the spring 4. The coil spring 4 between the legs 2A, 2B mounting formations 9A, 9B biases the legs 2A, 2B to stay in that splayed state. The spring 4 provides resistance to the user exercising their mouth by pouting, resisting closing together of the legs 2A, 2B. If the user needs or wants to have a spring 4 of greater or lesser length and or higher or lower compression resistance force in the apparatus then they need only hold the legs 2A, 2B apart and compress the spring 4 to remove its ends from the opposing mounting lugs 5A, 5B and replace the spring 4 with a different spring 4.

Referring now to FIGS. 4 to 7, a second embodiment of the invention is illustrated in which the basic structure and configuration of the apparatus is the same as in the first embodiment (like parts being identified by like reference numerals) but the mouth mounting formations 9A, 9B are altered for further enhanced ergonomics in lip-training. In this embodiment the modified mouth mounting formations 9A', 9B' are adapted to cradle against the user's lips at the corner of their mouth. The lip mounting formations 9A', 9B' are everted rather than inverted, which is to say that they project laterally outwardly from the legs 2A, 2B, not between the legs. They each present a concave surface facing laterally outwardly away from each other, each concave surface serving for cradling over an opposing lip region of the user's mouth. As seen best in FIG. 7, these lip mounting formations 9A', 9B' extend rearwardly of the common plane of the legs 2A, 2B and are, as viewed in plan, splayed apart relative to each other by an angle of about 30 degrees. This aids comfort and efficacy in use.

The apparatus of the present invention is well-suited to being hand-held in use in view of the lengthy sturdy legs and enlarged profile of the proximal ends of the legs and the pivot assembly. The user can readily grip and hold the apparatus at the pivot assembly end and comfortably maintain the apparatus in place at the optimal position and angle for exercising their lips and cheeks.

What is claimed is:

1. An oro-facial exerciser apparatus for exercising and training the muscles of the lips of a face of a user, the oro-facial exerciser apparatus comprising:

a pair of legs pivotally connected together to form a pivot and to pivot between a first closed state and a second open state;

the pair of legs each comprising:

a proximal end proximate the pivot; and a distal end remote from the pivot, the distal end having a mouth mounting formation configured to mount the distal end to a respective opposing location of the mouth of the user;

a mounting lug extending from each leg of the pair of legs wherein the mounting lugs extend towards each other between the pair of legs;

a pivot socket hole through the proximal end; and compression coil spring extending between and coupled to the mounting lugs of the pair of legs for biasing the pair of legs towards the second open state and thereby provide a resistance force against which the lips of the user press, in use;

a pivot cap;

a bolt comprising:

a head; and a shank, wherein the shank extends through the pivot socket holes of the pair of legs and is retained by said pivot cap;

wherein the pivot cap is configured on an opposing side of the pair of legs from the head of the bolt to hold the pair of legs together; and wherein the compression coil spring is de-mountably mounted between the pair of legs to be replaceable and is compressed when the distal ends of the pair of legs are moved toward each other.

2. The oro-facial exerciser apparatus as claimed in claim 1, wherein the mounting lugs are cylindrical protrusions from the pair of legs and wherein the coil spring extends around the mounting lugs.

3. The oro-facial exerciser apparatus as claimed in claim 2, comprising a set of differing compression springs, each to provide a different resistance force or of different lengths to enable escalating resistance training or to better suit the user's needs.

4. The oro-facial exerciser apparatus as claimed claim 3, wherein the pair of legs open and close together in a common plane and the mouth-mounting formations extend projecting outwardly from the common plane of the pair of legs.

5. The oro-facial exerciser apparatus as claimed in claim 4, wherein the mouth-mounting formations are lip-mounting formations.

6. The oro-facial exerciser apparatus as claimed in claim 1, wherein the mouth-mounting formations are lip-mounting formations.

7. The oro-facial exerciser apparatus as claimed in claim 6, wherein the lip mounting formations extend outwardly oblique/transverse to the pair of legs and not between the pair of legs and are oriented splayed apart.

8. The oro-facial exerciser apparatus as claimed in claim 7, wherein the lip-mounting formations each have an outer concave surface to sit as a saddle or cradle over the lip of said user.

9. The oro-facial exerciser apparatus as claimed in claim 1 comprising a set of differing compression springs, each to provide a different resistance force or of different lengths to enable escalating resistance training or to better suit the user's needs.

10. The oro-facial exerciser apparatus as claimed claim 9, wherein the pair of legs open and close together in a common plane and the mouth-mounting formations extend outwardly from the common plane of the pair of legs.

11. The oro-facial exerciser apparatus as claimed claim 1, wherein the pair of legs open and close together in a common plane and the mouth-mounting formations extend projecting outwardly from the common plane of the pair of legs.

12. The oro-facial exerciser apparatus as claimed in claim 11, wherein the mouth-mounting formations are lip-mounting formations.

13. The oro-facial exerciser apparatus as claimed in claim 1, wherein the mouth-mounting formations are cheek abutting formations adapted to be inserted within the mouth of the user with one at each respective corner of the mouth pressing out against the cheek of the mouth of the user.

14. The oro-facial exerciser apparatus as claimed in claim 13 wherein the cheek-mounting formations each have an outer convex surface to press against the cheek of the mouth of the user.

* * * * *